US010815755B2

(12) United States Patent
Saraya

(10) Patent No.: US 10,815,755 B2
(45) **Date of Patent: *Oct. 27, 2020**

(54) METHODS AND SYSTEMS FOR A FRAC SLEEVE

(71) Applicant: Vertice Oil Tools, Missouri City, TX (US)

(72) Inventor: Mohamed Ibrahim Saraya, Sugar Land, TX (US)

(73) Assignee: Vertice Oil Tools Inc., Missouri City, TX (US)

( * ) Notice: Subject to any disclaimer, the term of this patent is extended or adjusted under 35 U.S.C. 154(b) by 213 days.

This patent is subject to a terminal disclaimer.

(21) Appl. No.: 16/012,336

(22) Filed: Jun. 19, 2018

(65) Prior Publication Data

US 2018/0298728 A1 Oct. 18, 2018

Related U.S. Application Data

(63) Continuation of application No. PCT/US2016/068315, filed on Dec. 22, 2016, and a continuation of application No. 14/987,559, filed on Jan. 4, 2016, now Pat. No. 9,574,421.

(51) Int. Cl.
*E21B 34/14* (2006.01)

(52) U.S. Cl.
CPC ..... *E21B 34/142* (2020.05); *E21B 2200/06* (2020.05); *E21B 2200/08* (2020.05)

(58) Field of Classification Search
CPC ..... E21B 43/26; E21B 34/14; E21B 2034/007
See application file for complete search history.

(56) References Cited

U.S. PATENT DOCUMENTS

2004/0163820 A1* 8/2004 Bishop ..... E21B 34/06 166/373

* cited by examiner

*Primary Examiner* — Robert E Fuller
(74) *Attorney, Agent, or Firm* — Pierson Intellectual Property LLC

(57) ABSTRACT

A frac sleeve includes an expandable ball seat configured to allow a single frac-ball to treat a plurality of zones associated with a plurality of frac sleeves.

14 Claims, 14 Drawing Sheets

METHODS AND SYSTEMS FOR A FRAC SLEEVE

BACKGROUND INFORMATION

Field of the Disclosure

Examples of the present disclosure relate to a frac sleeve with expandable ball seat. More specifically, embodiments include an expandable ball seat within a frac sleeve, wherein the expandable ball seat is configured to allow a single frac-ball to treat a plurality of zones associated with a plurality of frac sleeves.

Background

Hydraulic fracturing is the process of creating cracks or fractures in underground geological formations. After creating the cracks or fractures, a mixture of water, sand, and other chemical additives, are pumped into the cracks or fractures to protect the integrity of the geological formation and enhance production of the natural resources. The cracks or fractures are maintained opened by the mixture, allowing the natural resources within the geological formation to flow into a wellbore, where it is collected at the surface.

Additionally, during the fracturing process, tools may be pumping through frac sleeves to enhance the production of the natural resources. One of the tools pumped through the frac sleeves are frac-balls. The frac-balls are configured to block off or close portions of a well to allow pressure to build up, causing the cracks or fractures in the geological formations and in other cases to shut these openings and isolate existing fracture to prevent production of un-required fluid.

Current or existing completion strings that utilize frac sleeves in wellbores are comprised of a plurality of frac sleeves, each having have tapered sidewalls. In order to activate each frac sleeve, properly sized frac-balls are pumped along with the mixture inside of the wellbore. Subsequent pumped frac-balls may have a larger diameter. The larger is smaller than the opening of all of the upper frac sleeves, but larger than the sleeve it is intended to open. Thus, current or existing completion strings that utilizes frac sleeves in wellbores require frac-balls of proper size to be sequentially pumped into a completion string.

When a properly sized frac-ball is positioned within a corresponding frac sleeve, the positioning of the frac-ball exerts pressure causing the frac sleeve activation or opening, consequently causing the pressure to fracture or crack in the geological formation. At the completion of each fracturing stage, a larger sized frac-ball is injected into the completion string, which opens up the next frac sleeve. This process repeats until all of the frac sleeves are opened, and multiple fractures are created in the wellbore.

Thus, conventional wellbores force fracturing to occur at the lowest frac sleeve first. This causes completion strings to be prone to accumulate undesired sand or mixtures in the wellbore after a fracking stage. Additionally, conventional wellbores rely on tapered frac sleeves corresponding to different sized frac-balls. This limits the number of stages in a completion string and frac rate due to the huge pressure drop across the frac sleeves with the smallest ball seats and limits the ability to efficiently treat the geological formation under consideration. After the multiple fractures are created in conventional wellbores, additional fractures cannot be created without intervention for mechanical activation.

Accordingly, needs exist for system and methods utilizing frac sleeves with a mechanism explained thereafter to allow a completion string to utilize a single frac ball, while allowing the fracking process to be performed from uppermost frac sleeve to a lowest frac sleeve. Additionally, needs exist for systems and methods utilizing frac sleeves with a mechanism configured to allow frac-sleeves to be used more than once.

SUMMARY

Embodiments disclosed herein describe a frac sleeve with an expandable ball seat. More specifically, embodiments include an expandable ball seat within a frac sleeve configured to allow a single ball to treat a plurality of zones associated with a plurality of frac sleeves.

Embodiments may include a frac sleeve with an outer sidewall and an inner sleeve. The outer sidewall may include an outer frac port, ring locking mechanism, and a vertically adjustable member. The inner sleeve may include an inner frac port, an expandable ball seat, and a variable port.

In embodiments, a frac-ball may be dropped within the inner sleeve and positioned on the expandable ball seat. When the frac-ball is positioned on the expandable ball seat, pressure may be applied within the frac sleeve to compress the vertically adjustable member. Responsive to compressing the vertically adjustable member, the inner sleeve may slide vertically within the outer sidewall.

In embodiments, responsive to vertically moving the inner sleeve, the outer frac port may become aligned with the inner frac port. When the outer frac port and inner frac port are aligned, fracking fluid may be transmitted from a position within the inner sleeve to a position outside of the outer sidewall via the aligned frac ports.

In embodiments, as the pressure within the frac sleeve is decreased, the vertically adjustable member may expand. Responsive to expanding the vertically adjustable member, the inner frac sleeve may slide upward causing the expandable ball seat may be aligned with the ring locking mechanism. When the expandable ball seat is aligned with the ring locking mechanism, the expandable ball seat may expand horizontally into the ring locking mechanism. Once the expandable ball seat expands, a diameter of the expandable ball seat may have a diameter that is greater than the frac-ball. This may allow the frac-ball to slide through the vertically adjustable member and into a lower positioned, second frac sleeve.

Additionally, when the vertically adjustable member is expanded, the variable port through the inner sleeve may be aligned with the outer frac port based on characteristics of the vertically adjustable member. In embodiments, the variable port may include removable material, such as dissolvable material or materials with different physical properties, which may temporarily seal an area within the frac sleeve from an area outside of the frac sleeve. After a period of time, the removable material may be removed, disappear, disintegrate, dissolve, etc., and an opening through the frac sleeve may be formed via the variable port in the inner sleeve and the outer port. The frac sleeve may receive natural resources, fluid, etc. from the fractures outside of frac sleeve through the opening or convey injection fluid. This process may be repeated for a plurality of frac sleeves.

Utilizing the single frac-ball, embodiments may allow the fracking process to occur from an uppermost frac sleeve to a lowermost frac sleeve. This may allow excess sand and fluid to flow downward, which may save fluid and leaving less sand in the well. Additionally, utilizing embodiments a seamless infinite number of fracking sleeves may utilize the single frac-ball for production. This may allow more fractures across a completion string. Embodiments may also reduce the amount of time required for dropping frac-balls of various sizes within conventional frac sleeves, and eliminate the time required to convey each ball size from surface down to desired frac-sleeve depth.

Embodiments may be utilized to displace conventional well systems, where excessive control lines are used to deploy hydraulically activated valve that operate through control line pressures.

Embodiments may be utilized in both cemented and un-cemented casing applications.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
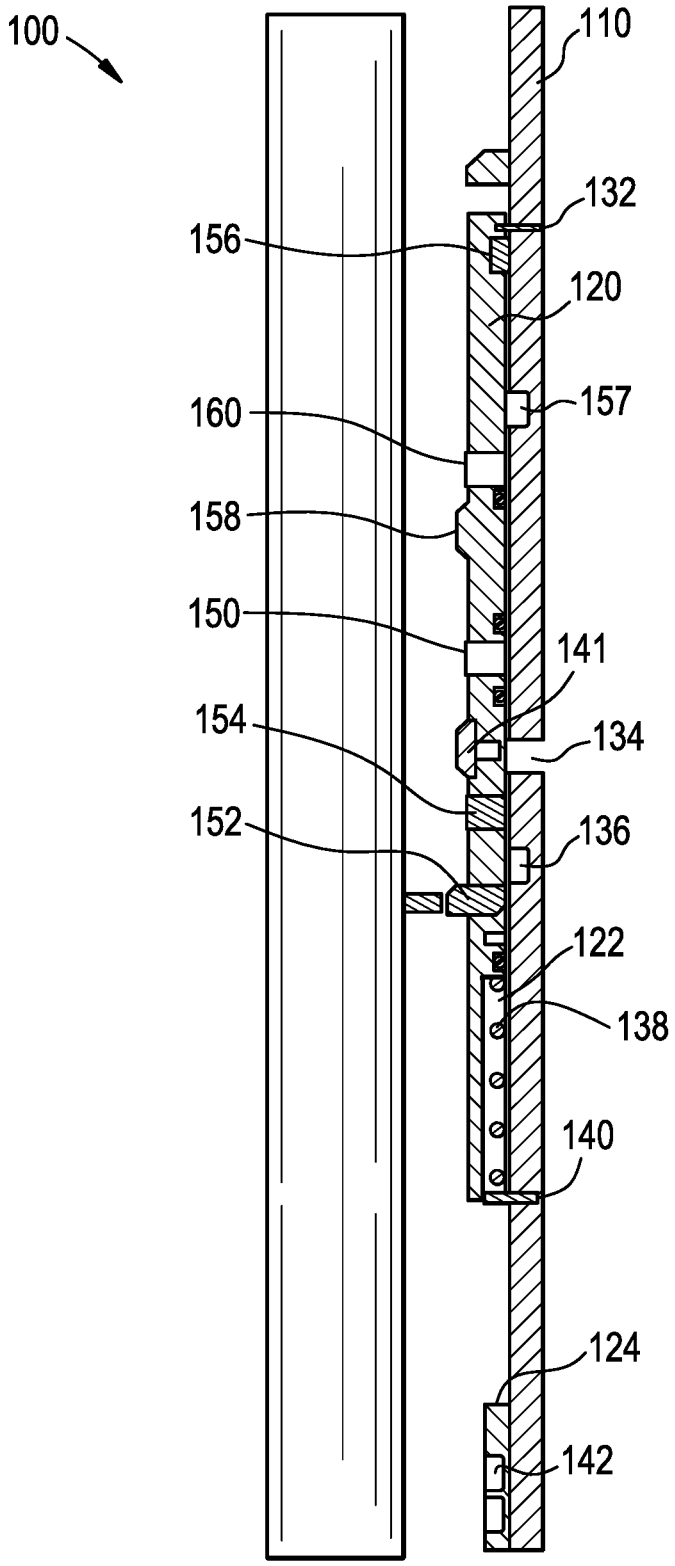
FIG. 1 depicts a frac sleeve, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Examples of the present disclosure relate to a frac sleeve with an expandable ball seat. More specifically, embodiments include an expandable ball seat within a frac sleeve configured to allow a single frac-ball to treat a plurality of zones associated with a plurality of frac sleeves.

Turning now to FIG. 1, FIG. 1 depicts a frac sleeve 100, according to an embodiment. In embodiments, a wellbore may include a plurality of frac sleeves 100, which may be vertically aligned across their axis with one another. The plurality of frac sleeves 100 may be aligned such that a first frac sleeve 100 is positioned above a second frac sleeve 100. Each frac sleeve 100 may be utilized to control the flow of fluid, gases, mixtures, etc. within a stage of a wellbore.

Frac sleeve 100 may include outer sidewall 110 and inner sleeve 120. Outer sidewall 110 and inner sleeve 120 may include a hollow chamber, channel, conduit, passageway, etc. The hollow chamber may extend from a top surface of outer sidewall 110 and inner sleeve 120 to a lower surface of outer sidewall 110 and inner sleeve 120.

Inner sleeve 120 may be positioned within hollow channel, and be positioned adjacent to outer sidewall 110. In embodiments, an outer diameter of inner sleeve 120 may be positioned adjacent to an inner diameter of outer sidewall 110. Outer sidewall 110 and inner sleeve 120 may have parallel longitudinal axis, and may not include tapered sidewalls.

Outer sidewall 110 may include upper shear screws 132, outer frac port 134, ring locking mechanism 136, vertically adjustable member 138, lower shear ring 140, and intervention tool locator 142.

Upper shear screws 132 may be positioned within outer sidewall 110, and extend into portions of inner sleeve 120. Upper shear screws 132 may be configured to temporarily couple inner sleeve 120 with outer sidewall 110. When coupled together, inner sleeve 120 may be secured to outer sidewall 110 at a fixed position within the hollow chamber of outer sidewall 110. Inner sleeve 120 and outer sidewall may remain coupled until a predetermined amount of force is applied within the hollow chamber. Responsive to the predetermined amount of force being applied within the hollow chamber, upper shear screws 132 may break, be removed, etc., and allow inner sleeve 120 to slide downward relative to outer sidewall 110.

Outer frac port 134 may be an opening, orifice, etc. extending through outer sidewall 110. Outer frac port 134 may be configured to control the flow of fluid, fracking materials, natural resources and any fluid through the hollow chamber. In embodiments, outer frac port 134 may be configured to be misaligned and aligned with ports positioned through inner sleeve 120. When misaligned with the ports within inner sleeve 120, outer frac port 134 may be sealed. When aligned with the ports within inner sleeve 120, outer frac port 134 may allow frac sleeve 100 to be operational.

In a first mode of operation, outer frac port 134 may be utilized to transport fracking mixtures from a location within the hollow chamber into geological formations positioned adjacent to the outer diameter of outer sidewall 110. In a second mode of operation, outer frac port 134 may be configured to receive natural resources from the geological formations, and the wellbore may be open for production.

Ring locking mechanism 136 may be an opening, orifice, recess, profile etc. extending from the inner diameter of outer sidewall 110 towards the outer diameter of outer sidewall 110. However, the opening associated with ring locking mechanism 136 may not extend completely through outer sidewall 110. Accordingly, a diameter across ring locking mechanism 136 may be larger than the diameter across the inner diameter of outer sidewall 110, but less than the diameter across the outer diameter of outer sidewall 110. In embodiments, ring locking mechanism 136 may be positioned below outer frac port 134, and above vertical adjustable member 138. Responsive to expandable ball seat 152 being vertically aligned with ring locking mechanism 136, the diameter of expandable ball seat 152 may expand with ring locking mechanism 136. Accordingly, ring locking mechanism 136 may be a recession within outer sidewall 110 that is configured to receive expandable ball seat 152.

Vertically adjustable member 138 may be a device or fluid chamber that is configured to move to vertically move inner sleeve 120. For example, vertically adjustable member 138 may be a spring, hydraulic lift, etc. In embodiments, a lower surface of vertically adjustable member 138 may positioned adjacent to lower shear ring 140, and an upper surface of vertically adjustable member 138 may be positioned adjacent to a first ledge, projection, protraction, etc. 122 on inner sleeve 120. Responsive to being compressed, vertically adjustable member 138 may shorten the distance between lower shear ring 140 and first ledge 122. Furthermore, responsive to being compressed, vertically adjustable member 138 may allow sleeve 120 to slide within outer sidewall 110. In embodiments, vertically adjustable member 138 may be positioned below ring locking mechanism 136. However, in other embodiments vertically adjustable member 138 may be positioned in various places in relation to inner sleeve.

Lower shear ring 140 may be positioned within outer sidewall 110, and extend into portions of inner sleeve 120. Lower shear ring 140 may be configured to receive force from vertically adjustable member 138, and to secure the lower surface of vertically adjustable member 138 in place. Lower shear ring 140 may be configured to secure the lower surface of vertically adjustable member 138 in place until a predetermined amount of force is applied within the hollow chamber, or until a predetermined amount of time has lapsed. In embodiments, a second frac-ball with a different diameter may be inserted into the hollow chamber. Upon inserting the second frac-ball within the hollow chamber, the second frac-ball may sit on collapsible ball seat 141. Collapsible ball seat 141 may be configured to secure the second frac-ball within the hollow chamber, allowing for pressure within the hollow chamber to once again be increased. Responsive to the predetermined amount of force being created or the predetermined amount of time lapsing, lower shear ring 140 may be removed from frac sleeve 100, and allow vertically adjustable member 138 and inner sleeve 110 to slide within the hollow chamber to a second ledge 124. In embodiments, collapsible ball seat 141 may be supported by a spring or other forces that expand and contract in a direction perpendicular to the longitudinal axis of frac sleeve 100. When a frac-ball is positioned on collapsible ball seat 141, and pressure is increased within the hollow chamber, the force exerted by the frac-ball may overcome the forces by the spring to compress the spring, and the frac-ball may pass through. Responsive to frac-ball passing through the hollow chamber, the spring may expand. Second ledge 124 may be positioned proximate to a distal end of frac sleeve 100. Second ledge 124 may be a projection, protrusion, etc. that extends from outer sidewall 110 into the hollow chamber. In embodiments, responsive to lower shear ring 140 being removed, a bottom surface of vertically adjustable member 138 may slide within the hollow chamber to be positioned adjacent to and on top of second ledge 124. When vertically adjustable member 138 is positioned adjacent to second ledge 124, outer frac port 134 may be misaligned with any ports within inner sleeve 120. This may shut of the stage in the completion string associated with frac sleeve 100. In embodiments, second ledge 124 may also be configured to allow re-fracking utilizing secondary inner frac port 160 within inner sleeve 120. Intervention tool locator 142 may be configured to allow a mechanical depth locator to selectively isolate inner sleeve 120. The intervention tool locator 142 may be configured to allow refracking or treating through the intervention tool locator 142. In embodiments, intervention tool locator 142 may be positioned proximate to an upper or lower surface of frac sleeve 100.

Inner sleeve 120 may include an inner frac port 150, expandable ball seat 152, variable port 154, re-frac snap ring 156, second re-frac tapering 158, secondary inner frac port 160 and collapsible ball seat 141.

Inner frac port 150 may be an opening, orifice, etc. extending through inner sleeve 120. Inner frac port 150 may be configured to control the flow of fluid, fracking materials, and natural resources through the hollow chamber. In embodiments, inner frac port 150 may be configured to be misaligned and aligned with outer frac port 134. When inner frac port 150 is misaligned with the outer frac port 134, the sidewalls of inner sleeve 120 may form a seal, and may not allow fluid to flow from the hollow into the geological formations via outer frac port 134. In embodiments, when operational, vertically adjustable member 138 may be compressed. This may align inner frac port 150 with outer frac port 134. When aligned inner frac port 150 and outer frac port 134 may form a continuous passageway allowing fracking fluid, other fluid or material to flow from the inner chamber into the geological formations to fracture and/or crack the geological formations.

Expandable ball seat 152 may be configured to secure a frac-ball within the hollow chamber. Expandable ball seat 152 may be comprised of two semi-circles with a hollow center. Expandable ball seat 152 may initially be positioned within a slot on inner sleeve 120, wherein the hollow center of expandable ball seat 152 is configured to have a variable diameter. In other words, expandable ball seat 152 may be substantially donut shaped. The variable diameter of expandable ball seat 152 may change based on a diameter of a structure positioned adjacent to the outer diameter circumference of expandable ball seat 152. Thus, expandable ball seat 152 may expand to have a circumference substantially the same size as the structure positioned adjacent to the outer diameter of expandable ball seat 152 and inside circumference slightly bigger than inner sleeve 120. Accordingly, when expandable ball seat 152 is positioned in the hollow chamber, expandable ball seat 152 may have a first diameter. When expandable ball seat is positioned within ring locking mechanism 136, expandable ball seat 152 may have a second diameter, wherein the first diameter is smaller than the second diameter.

In embodiments, a frac-ball with a third diameter may be dropped within the hollow chamber, wherein the third diameter may be greater than the first diameter but less than the second diameter. Accordingly, when expandable ball seat 152 has the first diameter, frac-ball may be configured to sit on an upper surface of expandable ball seat 152. However, when expandable ball seat 152 has the second diameter, the frac-ball may fall through expandable ball seat 152. In embodiments, expandable ball seat 152 may be positioned below variable port 154 and inner frac port 150. In embodiments, collapsible ball seat 141 may be designed similarly or differently than expandable ball seat 152.

Variable port 154 may be an opening, orifice, etc. extending through inner sleeve 120. Variable port 154 may be filled with or include variable material. For example, variable port 154 may be filled with a dissolvable material that may be removed after a certain amount of time or after fluid pressure is applied to the removable material or after certain fluid is pumped through. In other embodiments, the removable material may be a door, flap, entrance, etc. that is configured to extend through the variable port 154. The door may seal variable port when extended. However, the door may be configured to rotate, move, etc. to be recessed in inner sleeve 120, etc. When rotated or moved, the door may form an opening through variable port 154.

In embodiments, when frac-ball 105 is positioned on expandable ball seat 152, variable port 154 may be misaligned with outer frac port 134. When expandable ball seat 152 is positioned within ring locking mechanism 136, variable port 154 may be aligned with outer frac port 134. However, if variable port 154 still includes the variable material, variable port 154 may form a seal between an area outside of frac sleeve 100 and the hollow chamber. Yet, if the variable material within variable port 154 has been removed or dissolved, then variable port 154 and outer frac port 134 may form a continuous passageway between the area outside of frac sleeve 100 and the hollow chamber. Accordingly, when the variable material is removed from variable port, production of natural resources within the geological formations may be transported into the hollow chamber via variable port 154 and outer frac port 134, or fluid can be injected back to geological formation.

Re-frac snap ring 156 may be configured to lock into a locking port 157 within outer sidewall 110. Re-frac snap ring 156 may be positioned proximate to a proximal end of inner sleeve 120, and above secondary inner frac port 160. Responsive to re-frac snap ring 156 being aligned with locking port 157, re-frac snap ring 156 may permanently secure inner sleeve 120 in place. In embodiments, re-frac snap ring 156 may be aligned with locking port 157 by dropping a second frac-ball within the hollow chamber, wherein the second frac-ball may be configured to sit on a re-frac tapering 158. By positioning the second frac-ball on re-frac tapering 158 and applying pressure within the hollow chamber, the pressure may force vertically adjustable member 138 to recompress. Responsive to positioning a corresponding frac-ball on re-frac tapering 158 and recompressing vertically adjustable member 138, a secondary passageway may be formed between the hollow chamber to an area outside of the frac sleeve 100 via secondary inner frac port 160 and outer frac port 134.

Collapsible ball seat 141 may be a projection in the hollow chamber where a different ball size (smaller than the smallest 158 but bigger than 152 when variable ports not aligned) can be dropped to close all or some of the frac sleeves to re-establish pressure integrity above the depth where the frac ball lands. Re-frac tapering 158 may be a projection into the hollow chamber, wherein different frac sleeves 100 may have different sized projections. Therefore, the diameter across the hollow chambers corresponding with different re-frac tapering 158 may be different. In embodiments, the lowest most frac sleeve 100 on a completion string may have the largest re-frac tapering 158, such that the diameter across the hollow chamber positioned at re-frac tapering 158 at the lower most frac sleeve 100 is the smallest. The second lowest frac sleeve 100 may have the second largest re-frac tapering 159, with the second smallest diameter, and so on. To re-fracture the frac sleeves 100 in a completion strings, different sized frac balls may be configured to be secured in place by the different sized re-frac taperings 158, wherein the smallest frac-ball may corresponding to the lowest most frac sleeve 100 on the completion string. In embodiments, re-frac tapering 158 may be configured to be positioned below secondary inner frac port 160, and above inner frac port 150.

FIGS. 2-7 depict phases of a method for operating a sliding frac sleeve 100. The operations of the method depicted in FIGS. 2-7 are intended to be illustrative. In some embodiments, the method may be accomplished with one or more additional operations not described, and/or without one or more of the operations discussed. Additionally, the order in which the operations of the method are illustrated in FIGS. 2-7 and described below is not intended to be limiting. Elements depicted in FIGS. 2-7 may be described above. For the sake of brevity, a further description of these elements is omitted.

Figure 2:
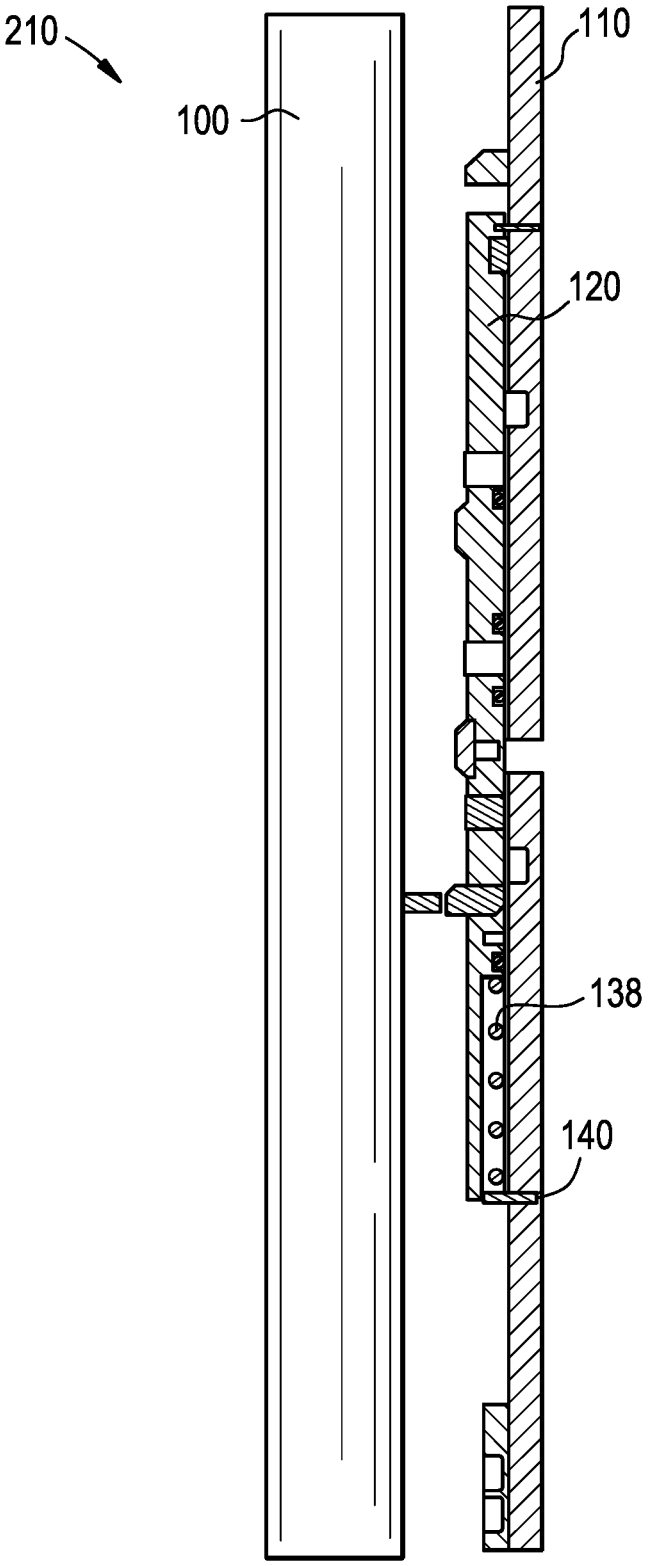
FIGS. 2-7 depict phases of a method for operating a sliding frac sleeve, according to an embodiment.

FIG. 2 depicts a first operation 210 utilizing frac sleeve 100. At operation 210, frac sleeve 100 may be positioned within a geological formation with natural resources that are desired to be extracted, or across a geological formation where injection of fluid is desired.

In operation 210, vertically adjustable member 138 may be extended, and a lower surface of vertically adjustable member 138 being positioned on lower shear ring 140. Due to vertically adjustable member 138 being extended and positioned on lower shear ring 140, the ports within inner sleeve 120 may not align with the port on outer sidewall 110, which may seal the hollow chamber within frac sleeve 100 from the geological formation.

Figure 3:
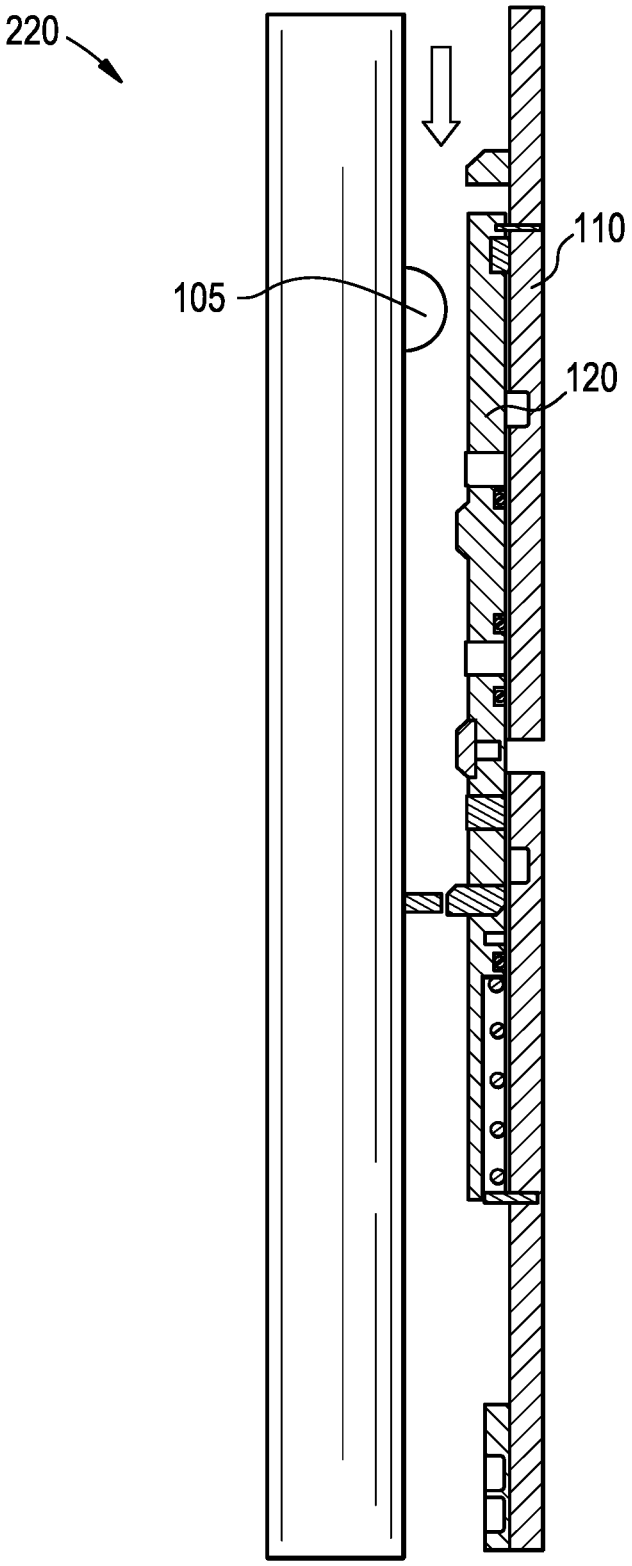

FIG. 3 depicts a second operation 220 utilizing frac sleeve 100. At operation 220, a frac-ball 105 may be dropped within the hollow chamber. Frac-ball 105 may enter the hollow chamber within frac sleeve 100 via an opening at the proximal end of frac sleeve 100, and fall towards the distal end of frac sleeve 100. In embodiments, the proximal end of frac sleeve 100 may be coupled to a distal end of another frac sleeve 100, or frac sleeve 100 may be the first frac sleeve 100 in a completion string.

Figure 4:
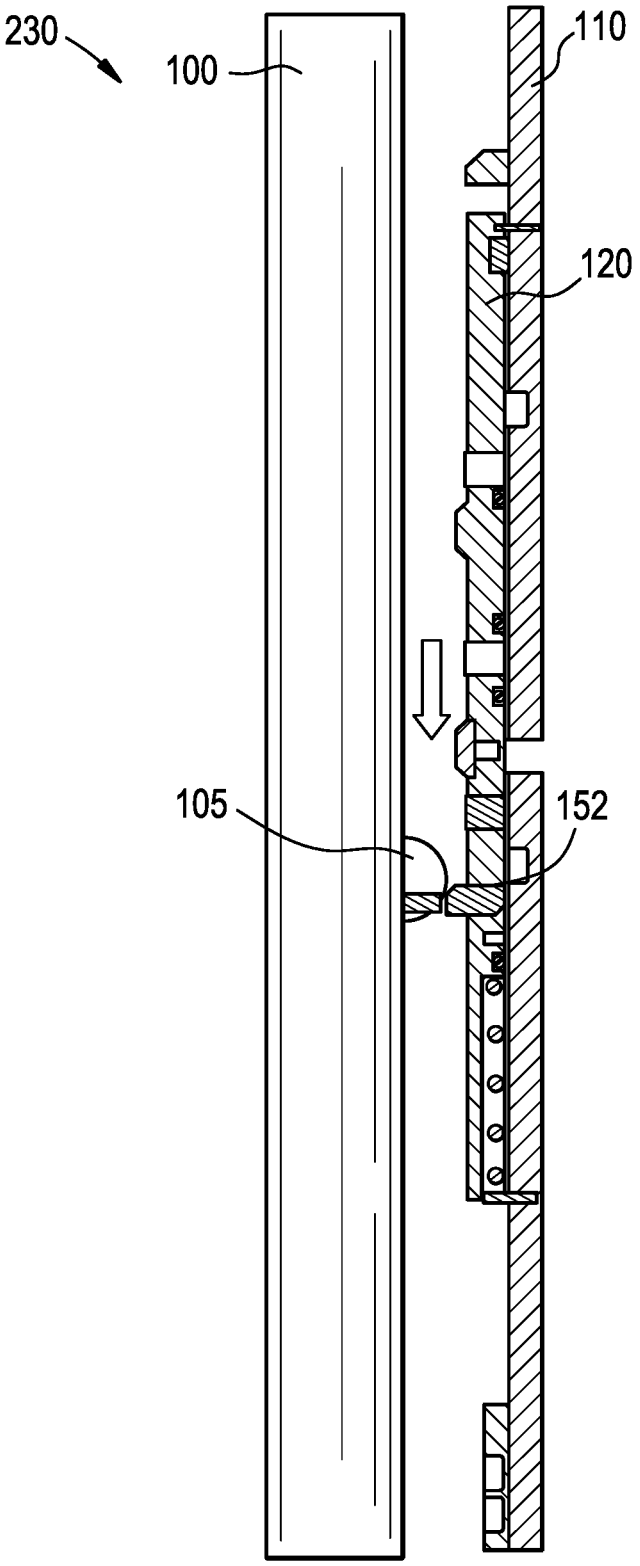

FIG. 4 depicts a third operation 230 utilizing frac sleeve 100. At operation 230, frac-ball 105 may land on an upper surface of expandable ball seat 152, wherein expandable ball seat 152 may secure frac-ball 105 in place. Furthermore, at operation 230, the outer diameter of expandable ball seat 152 may be substantially the same as the diameter of the inner diameter of outer sidewall 110.

Figure 5:
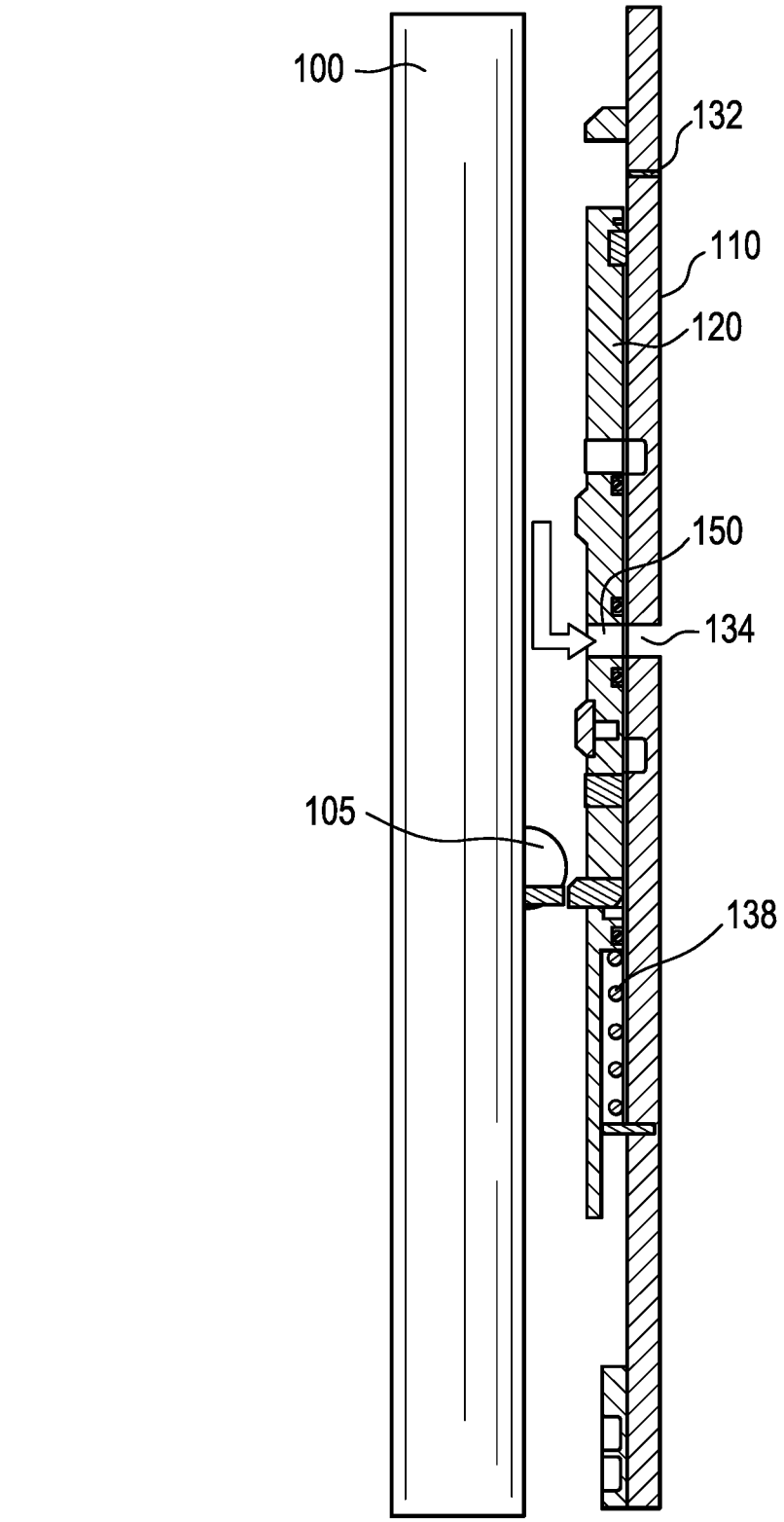

FIG. 5 depicts a fourth operation 240 utilizing frac sleeve 100. At operation 240, pressure may be applied through the proximal end of frac sleeve 100 into the hollow chamber. Due to the positioning of frac-ball 105 on expandable ball seat 152, the pressure within the hollow chamber may break upper shear screws 132 and compress vertically adjustable member 138. Responsive to compressing vertically adjustable member 138, inner sleeve 120 may move downward to align inner frac port 150 with outer frac port 134 to form a passageway from the hollow chamber, through inner sleeve 120 and outer sidewall 110, and into the geological formation.

Utilizing the passageway, a fracking mixture, fluid or material may be moved from the hollow chamber into the geological formation encompassing frac sleeve 100.

Figure 6:
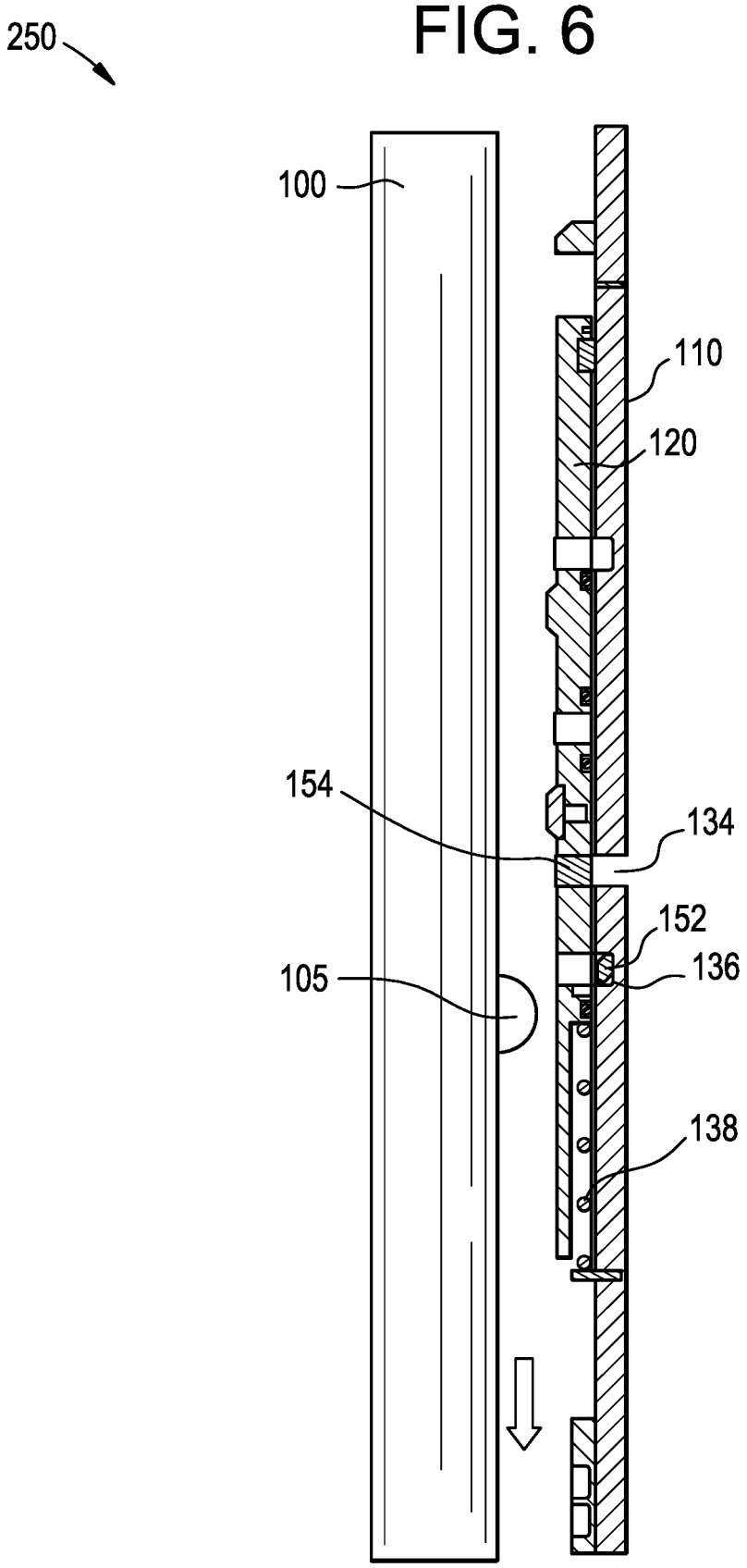

FIG. 6 depicts a fifth operation 250 utilizing frac sleeve 100. At operation 250, pressure within the hollow chamber may decrease. After the pressure within the hollow chamber decreases, vertical adjustable member 138 may expand, and inner sleeve 120 may upwardly slide. When inner sleeve 120 moves upward, expandable ball seat 152 may be vertically aligned with ring locking mechanism 136. Responsive to aligning expandable ball seat 152 and ring locking mechanism 136, expandable ball seat 152 may expand, increasing the inner, open, circumference of expandable ball seat 152. When increasing the inner diameter of expandable ball seat 152, frac ball 105 may have a diameter that is less than the inner diameter of expandable ball seat 152. Thus, expandable ball seat may not be able to support frac-ball 105, and frac-ball may move downward through the vertically adjustable member 138 and out the distal end of frac sleeve 100.

Additionally, responsive to aligning expandable ball seat 152 and ring locking mechanism 136, variable port 154 may be vertically aligned with outer frac port 134. The variable material within variable port 154 may act as a seal between the hollow chamber and the geological formation.

Figure 7:
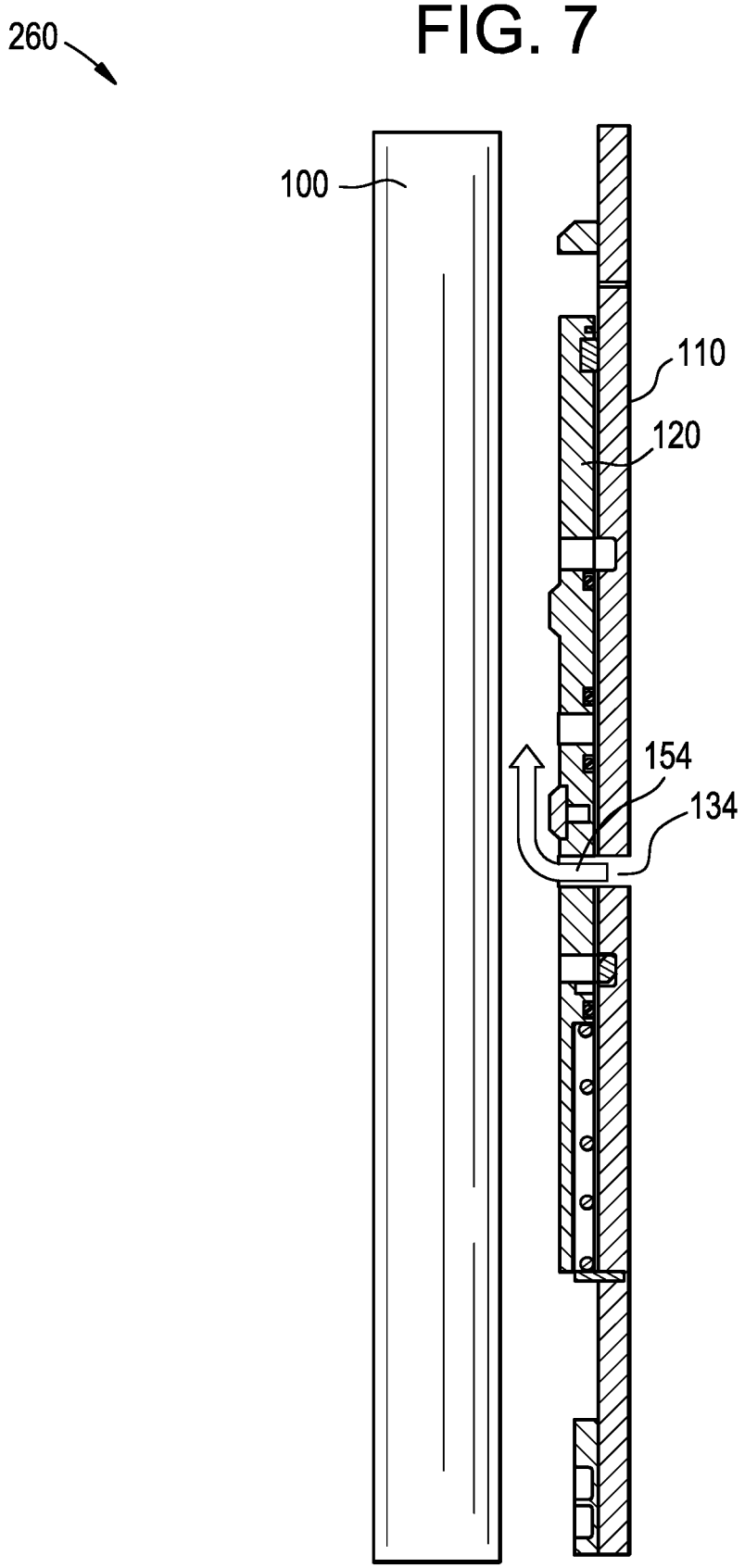

FIG. 7 depicts a sixth operation 260 utilizing frac sleeve 100. At operation 260, the variable material within variable port 154 may dissolve, disappear, disintegrate, be moved, etc. Responsive the variable material being removed from the variable port 154, a passageway from the geological formation to the hollow chamber may be formed via variable port 154 and outer frac port 134. Utilizing the passageway, the well may be up for production or injection.

This process may be repeated for a plurality of stages or zones for a completion string. In embodiments, responsive to frac-ball 105 moving out of the distal end of a first frac sleeve, the frac-ball may move into the hollow chamber of a subsequent, and lower second frac sleeve.

Figure 8:
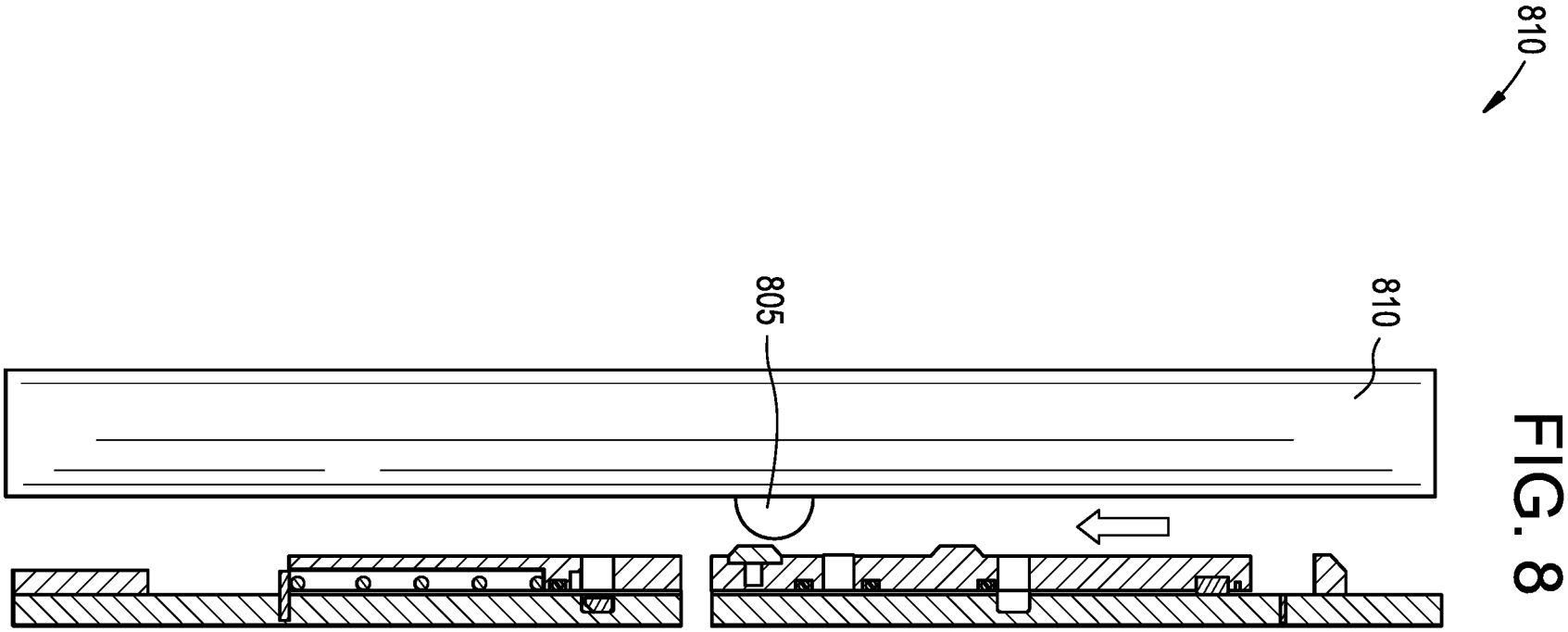
FIGS. 8-10 depict phases of a method for operating a sliding frac sleeve, according to an embodiment.
Figure 9:
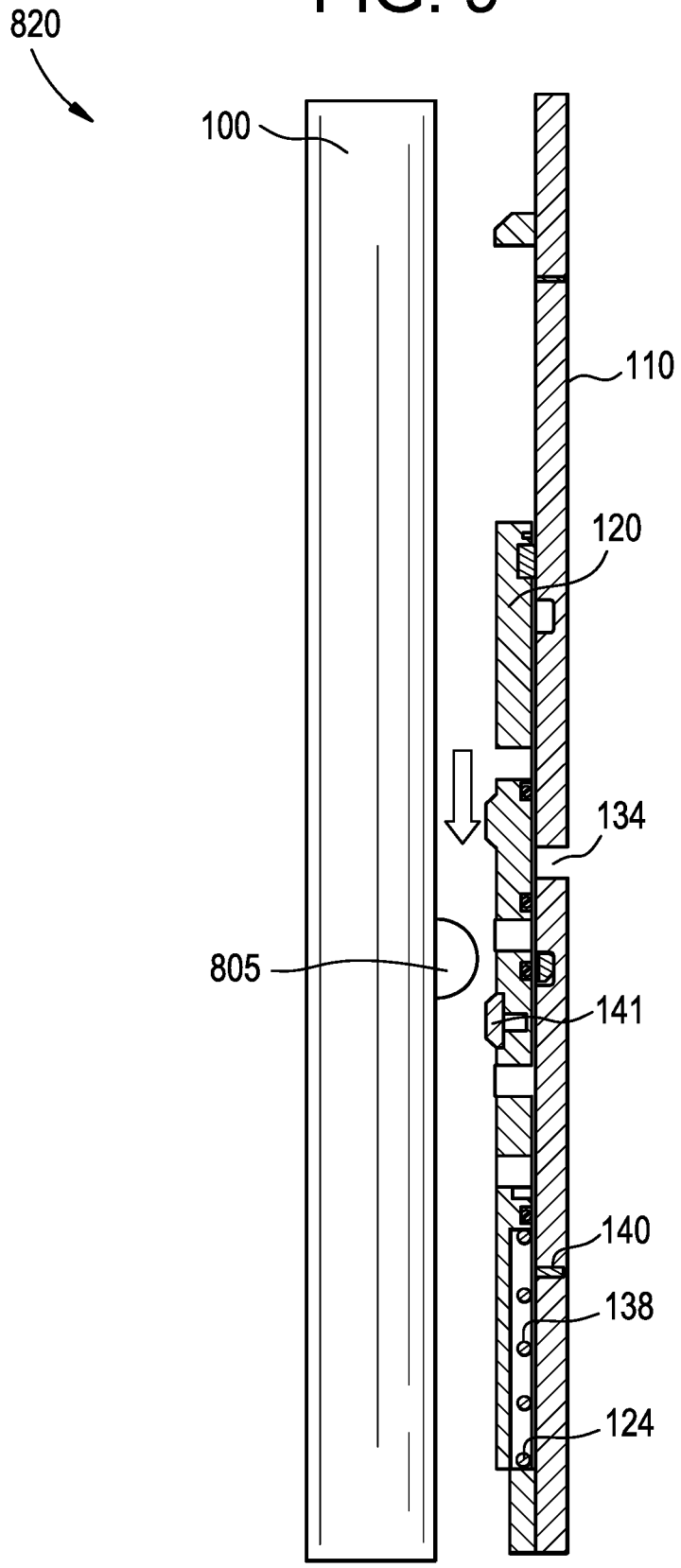
Figure 10:
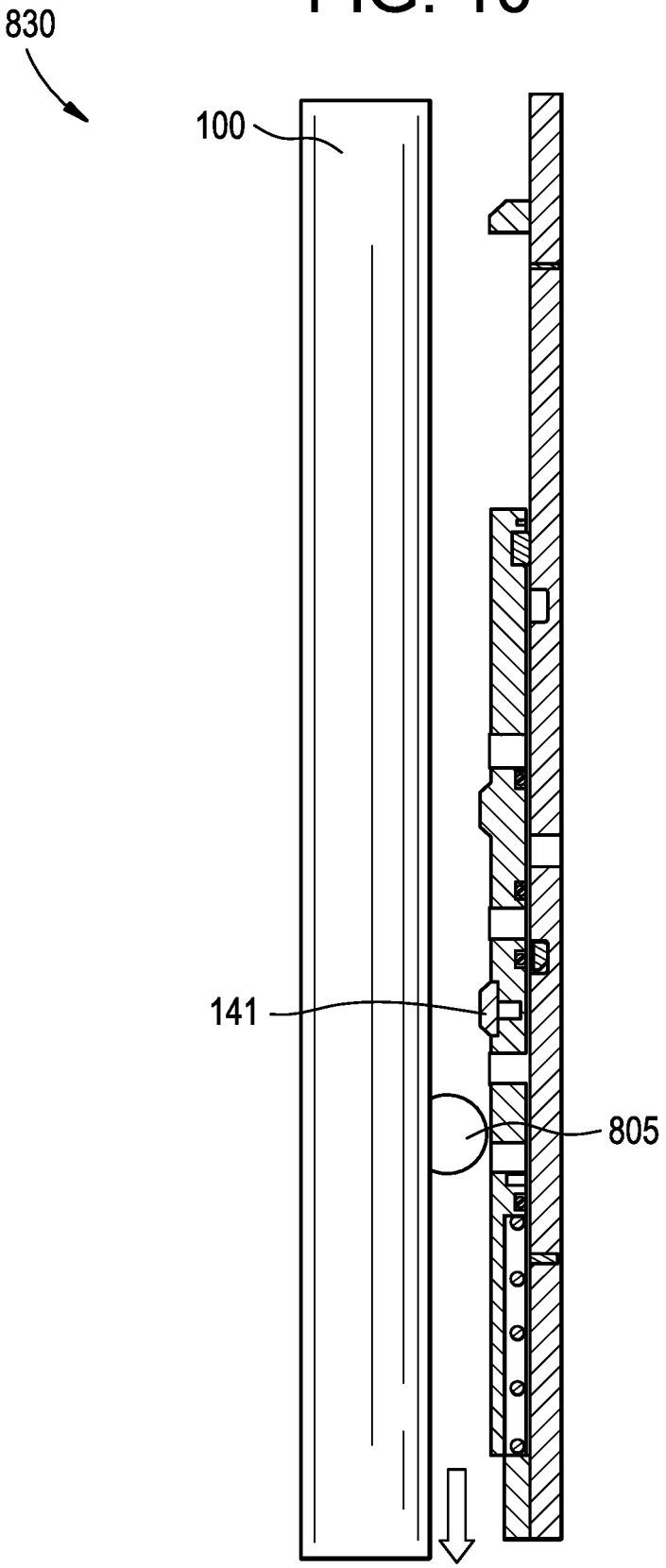

FIGS. 8-10 depicts a phases of a method 800 for operating a sliding frac sleeve 100. The operations of the method depicted in FIGS. 8-10 are intended to be illustrative. In some embodiments, the method may be accomplished with one or more additional operations not described, and/or without one or more of the operations discussed. Additionally, the order in which the operations of the method are illustrated in FIGS. 8-10 and described below is not intended to be limiting. Elements depicted in FIGS. 8-10 may be described above. For the sake of brevity, a further description of these elements is omitted.

At operation 810, as depicted in FIG. 8, a closure ball 805 may be dropped into frac sleeve 100 via the proximal end of frac sleeve 100. In embodiments, closure ball 805 may have a larger diameter than first frac-ball 105.

At operation 820, as depicted in FIG. 9, responsive to dropping closure ball closure ball 805 within the hollow chamber, closure ball closure ball 805 may be secured in place on collapsible ball seat 141. When closure ball 805 is secured on collapsible ball seat 141 pressure within the hollow chamber may be increased. The increased pressure may cause lower shear ring 140 to be removed, and allow vertically adjustable member 138 to slide to second ledge 124.

Based on the new positioning of vertically adjustable member 138, inner sleeve 120 may also corresponding slide downward within the hollow chamber. By moving inner sleeve 120 within hollow chamber, outer frac port 134 may be misaligned with any ports within inner sleeve 120.

At operation 830, as depicted in FIG. 10, collapsible ball seat 141 may extended. Expanding collapsible ball seat 141 may cause closure ball 805 to drop to the next frac sleeve 100. This may repeated until all of the frac sleeves within a completion string are closed.

FIGS. 11-14 depicts a phases of a method 1100 for operating a sliding frac sleeve 100. The operations of the method depicted in FIGS. 11-14 are intended to be illustrative. In some embodiments, the method may be accomplished with one or more additional operations not described, and/or without one or more of the operations discussed. Additionally, the order in which the operations of the method are illustrated in FIGS. 11-14 and described below is not intended to be limiting. Elements depicted in FIGS. 11-14 may be described above. For the sake of brevity, a further description of these elements is omitted.

Figure 11:
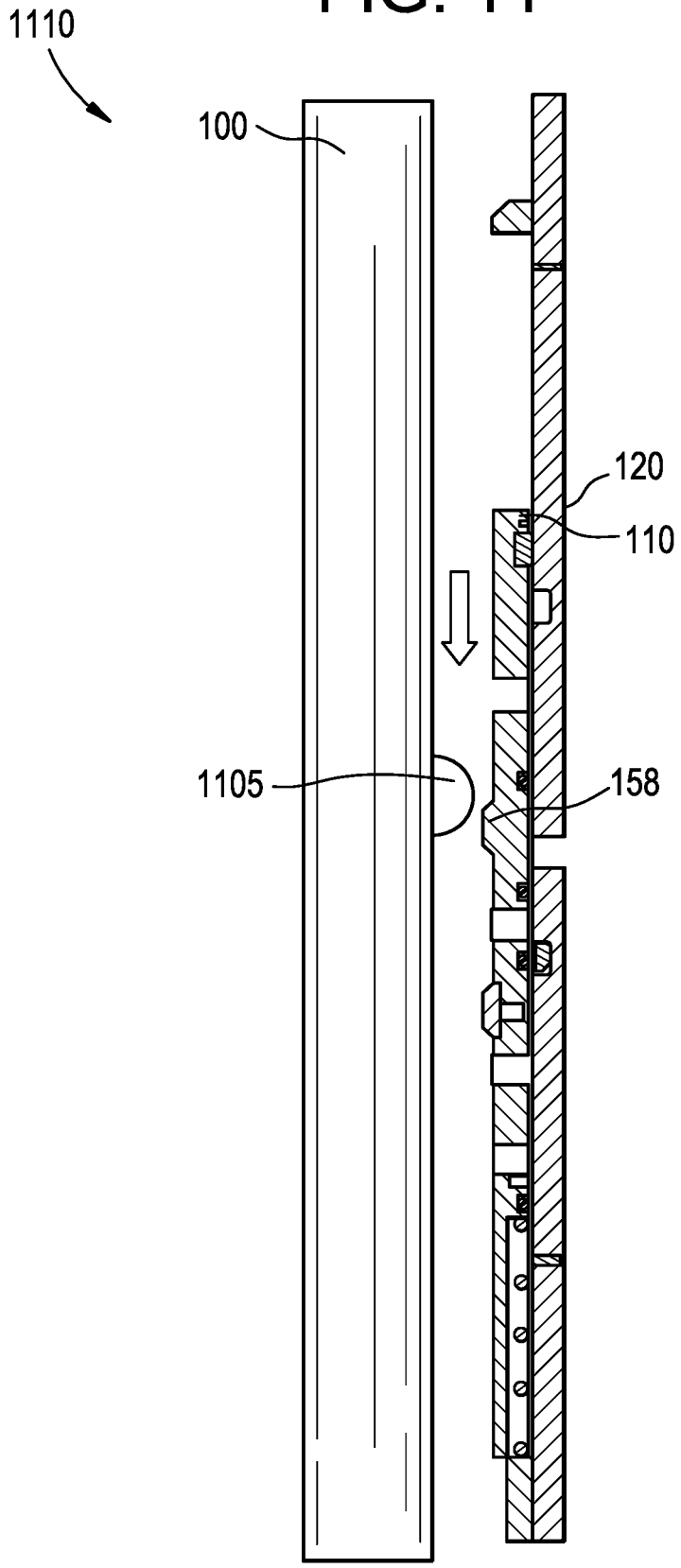
FIGS. 11-14 depict phases of a method for operating a sliding frac sleeve, according to an embodiment.

At operation 1110, as depicted in FIG. 11, a tapered frac-ball 1105 may be dropped into the hollow chamber of frac sleeve 100 after lower shear ring 140 have been removed and vertically adjustable member is positioned on lower ledge 124. In embodiments, a first tapered frac-ball may be initially dropped into the hollow chamber of the frac sleeve 100, wherein the first tapered frac-ball corresponds with the lowest-most frac sleeve in a completion string. Next, a second tapered frac-ball may be dropped into the hollow chamber of the frac sleeve, wherein the second tapered frac-ball corresponds with the second lowest-most frac sleeve in a completion string.

Furthermore, at operation 1110, the tapered frac-ball 1105 may be configured to be secured within the hollow chamber via re-frac tapering 158.

Figure 12:
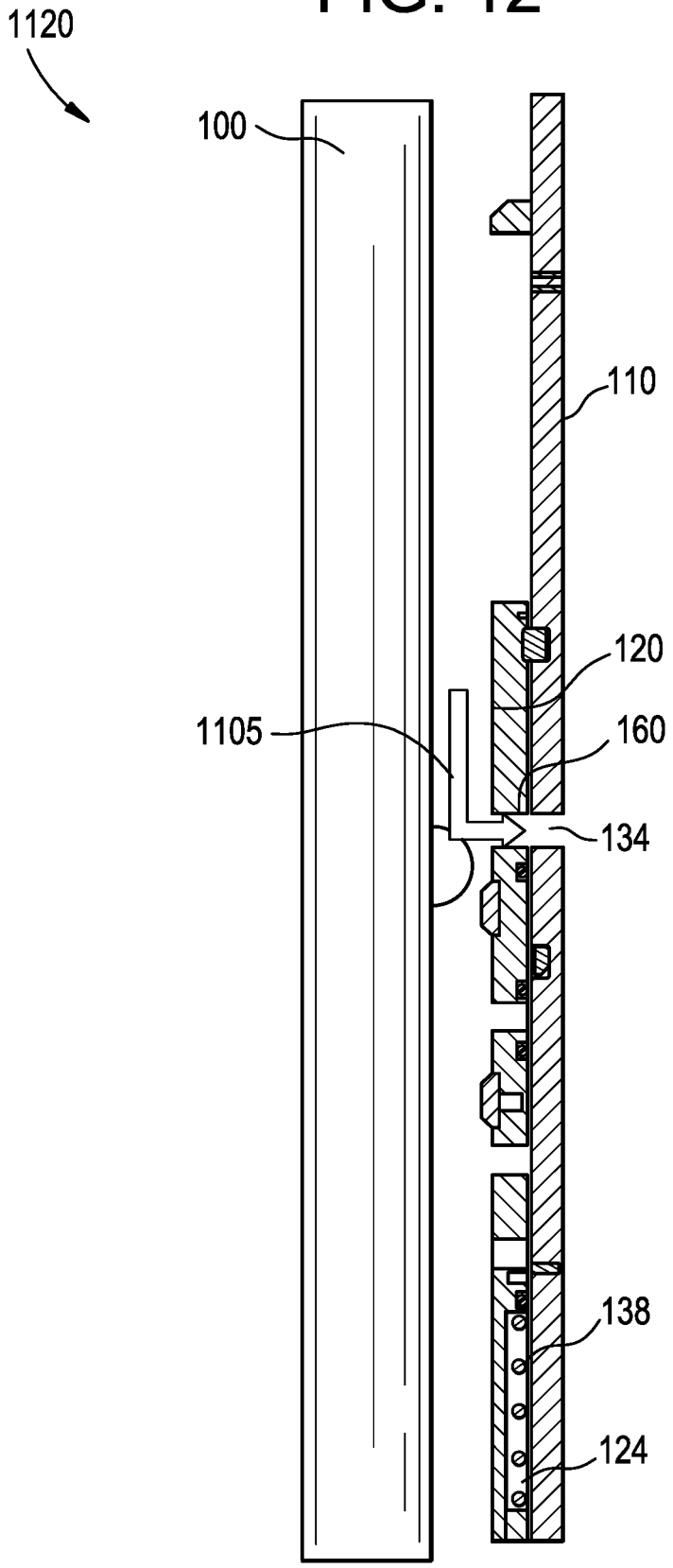

At operation 1120, as depicted in FIG. 12, pressure may be applied within the hollow chamber of frac-sleeve 100. Based on the buildup of pressure within the hollow chamber, vertically adjustable member 138 may compress.

When vertically adjustable member 138 compressed and positioned on lower ledge 124, secondary inner frac port 160 may be vertically aligned with outer frac port 134. The alignment of secondary inner frac port 160 and outer frac port 134 may form a passageway between the hollow chamber to the geological formation. Utilizing the passageway, fracking mixture may be moved from the hollow chamber into the geological formation to re-frac the stage or in another circumstances the frac sleeve 100 can be utilized directly for production or injection. The passageway may be positioned above re-frac tapering 158, which is securing first tapered frac-ball 1105 in place.

Figure 13:
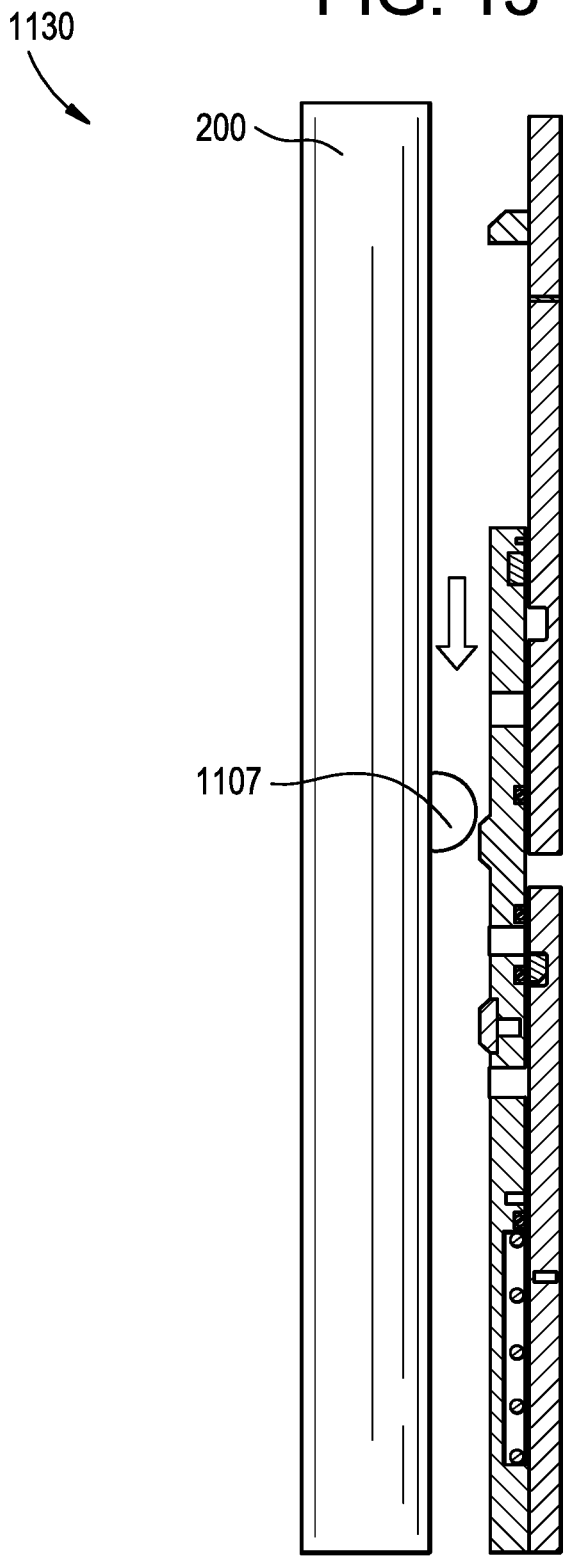

At operation 1130, as depicted in FIG. 13, a second tapered frac-ball 1107 may be dropped into the hollow chamber of a second lowest frac sleeve 200. Then, the operation 1120 may be repeated at the next highest frac sleeve. This process may be repeated for multiple stages of the completion string.

Figure 14:
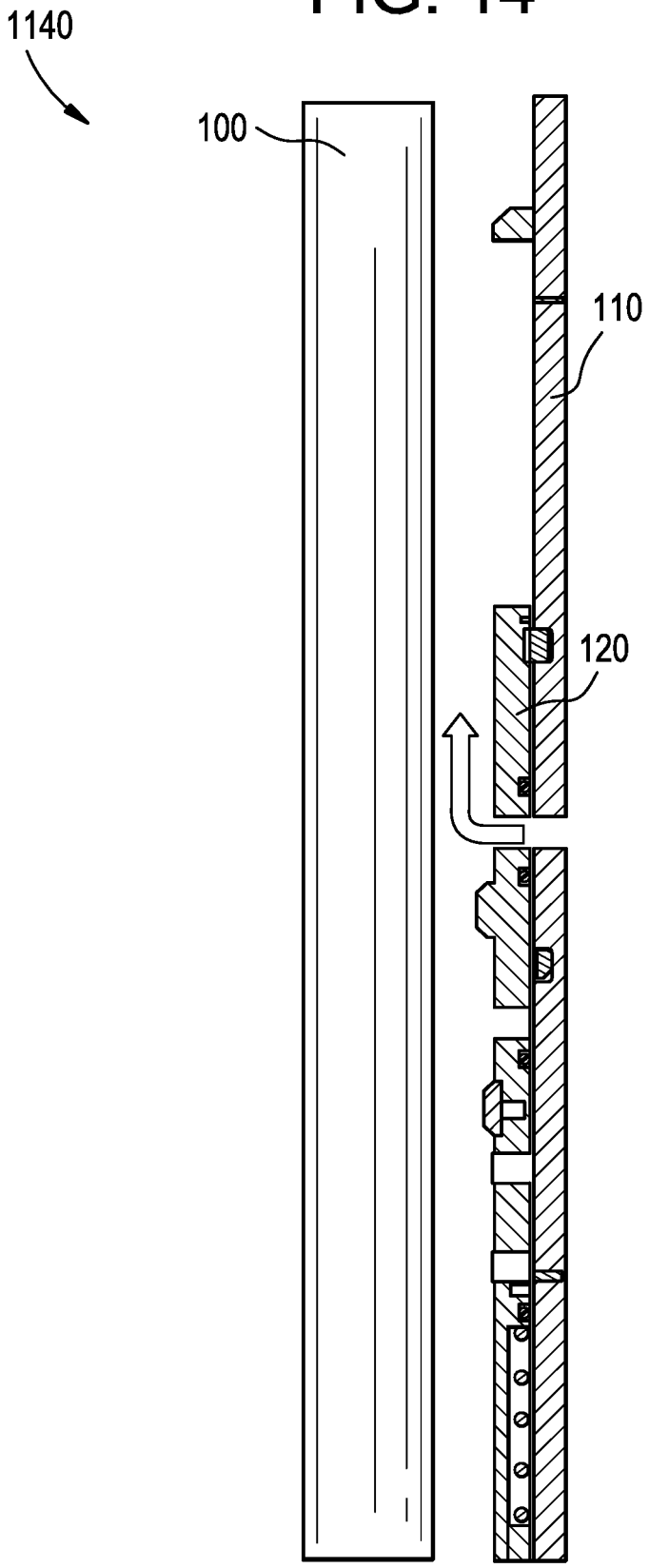

At operation 1140, as depicted in FIG. 14, responsive to fracking the stage at operation 1120, the stage may be open for production or injection. When the stage is open for production, natural resources may move from the geological formation into the hollow chamber associated with the frac sleeve 100 via the passageway. This process may be repeated for multiple stages of the completion string.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

After consuming all balls associated with the system, an intervention tool can be lowered in the well and intervention tool locator can be used to locate the desired frac sleeve where the intervention tool will straddle and treat the corresponding geological formation the frac sleeve is set against Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

The invention claimed is:

1. A frac sleeve comprising:

an inner sleeve configured to move relative to an outer sidewall;

a ball seat configured to selectively engage with a frac-ball, the ball seat having an open inner diameter;

an adjustable member being configured to elongate to increase the open inner diameter of the ball seat;

a ring locking mechanism positioned on the outer sidewall configured to secure the ball seat within the outer sidewall;

wherein when the pressure within inner sleeve above the frac-ball engaged on the ball seat decreases, the adjustable member extends to vertically align the ring locking mechanism and the ball seat.

2. The system of claim 1, wherein the adjustable member is configured to move based on a pressure within the inner sleeve.

3. The system of claim 1, wherein the adjustable member is configured to break a lower shear ring responsive to an increase in pressure within the frac sleeve when the frac ball is positioned on the ball seat.

4. A frac sleeve comprising:

an inner sleeve configured to move relative to an outer sidewall;

a ball seat configured to selectively engage with a frac-ball, the ball seat having an open inner diameter;

an adjustable member being configured to elongate to increase the open inner diameter of the ball seat;

a ring locking mechanism positioned on the outer sidewall configured to secure the ball seat within the outer sidewall;

a variable port positioned on the inner sleeve, the variable port being positioned below an inner frac port and including a variable material, the variable material being configured to be removed from the variable port.

5. The system of claim 4, wherein when the variable material is positioned within a variable port, the variable material sealing an outer frac port positioned on the outer sidewall.

6. The system of claim 5, wherein when the ball seat is vertically aligned with the ring locking mechanism, the variable port is vertically aligned with the outer frac port.

7. The system of claim 6, wherein when the outer frac port and the variable port are aligned and the variable material is removed from the variable port, a passageway is formed through the outer frac port and the variable port.

8. A method of utilizing a frac sleeve comprising:

moving an inner sleeve relative to an outer sidewall;

positioning a frac-ball through the inner sleeve;

selectively engaging the frac-ball with a ball seat the ball seat having an open inner diameter;

elongating an adjustable member responsive to an increase of the open inner diameter of the ball seat and responsive to a decrease in pressure within the inner sleeve above the frac-ball engaged on the ball seat;

securing the ball seat in place within a ring locking mechanism positioned on the outer sidewall;

wherein the elongation of the adjustable member vertically aligns the ring locking mechanism and the ball seat.

9. The method of claim 8, further comprising:

moving the adjustable member based on a pressure within the inner sleeve.

10. The method of claim 8, further comprising:

breaking a lower shear ring responsive to an increase in pressure within the frac sleeve when the frac-ball is positioned on the ball seat.

11. The method of claim 8, further comprising:

removing variable material from a variable port positioned on the inner sleeve, the variable port being positioned below an inner frac port.

12. The method of claim 11, further comprising:

sealing an outer frac port positioned on the outer sidewall via the variable material.

13. The method of claim 12, further comprising:

aligning the variable port with the outer frac port when the ball seat is vertically aligned with the ring locking mechanism.

14. The method of claim 13, further comprising:

forming a passageway through the outer frac port and the variable port when the outer frac port and the variable port are aligned and the variable material is removed from the variable port.

* * * * *